United States Patent [19]

Santos, Jr. et al.

[11] Patent Number: 4,533,112

[45] Date of Patent: Aug. 6, 1985

[54] CURB STAKE WITH INTEGRAL SUPPORT

[75] Inventors: Theodore J. Santos, Jr.; Gordon E. Pearlman, both of Los Angeles, Calif.

[73] Assignee: Western Steel Cutting, Inc., Los Angeles, Calif.

[21] Appl. No.: 540,519

[22] Filed: Oct. 11, 1983

[51] Int. Cl.[3] ..... E01C 19/50

[52] U.S. Cl. ..... 249/3; 135/118; 249/4; 249/207

[58] Field of Search ..... 249/2, 3, 4, 5, 6, 7, 249/207, 208; 135/118; 238/366

[56] References Cited

U.S. PATENT DOCUMENTS

| | | | |
|---|---|---|---|
| 1,527,698 | 2/1925 | Pearthree | 249/7 |
| 1,555,322 | 9/1925 | Kleinhesselink | 135/118 |
| 1,607,690 | 11/1926 | Rue | 249/207 |
| 1,741,829 | 12/1929 | Cucolo | 249/207 |
| 1,897,530 | 2/1933 | Pandolfi | 249/4 |
| 3,195,898 | 7/1965 | Respini | 135/118 |
| 3,280,829 | 10/1966 | Glendenning et al. | 135/118 |
| 3,300,920 | 1/1967 | Skaare | 249/3 |

*Primary Examiner*—Jay H. Woo
*Assistant Examiner*—James C. Housel
*Attorney, Agent, or Firm*—Pretty, Schroeder, Brueggemann & Clark

[57] ABSTRACT

A curb stake for use in securing a concrete form in a prescribed location, the curb stake including an elongated shaft and integral support structure that cooperate to resist both outward displacement and outward pivoting of the concrete form when concrete is poured on its opposite or inward side. The support structure includes a generally horizontal member that abuts the ground when the shaft has been driven a predetermined distance into the ground, along with a spike that projects into the ground at a location spaced from the shaft. The support structure further provides an impact surface for convenient use in driving the stake into the ground, to a depth below that of the top edge of the concrete form, along with an opening for convenient use in extracting the stake from the ground after the poured concrete has been finished and set.

8 Claims, 5 Drawing Figures

CURB STAKE WITH INTEGRAL SUPPORT

BACKGROUND OF THE INVENTION

This invention relates generally to forms for use in the laying of concrete pads, and, more particularly, to curb stakes for use in holding the forms in place when the concrete pads are formed.

Curb stakes of this particular kind typically take the form of elongated shafts of wood or steel. The lower ends of the stakes are pointed, to facilitate their being driven into the ground immediately adjacent to a concrete form. The concrete forms are typically constructed of lengths of 2×4 or 2×6 lumber, which are laid end to end and held in place by a number of stakes spaced generally about two to six feet apart from each other. The stakes function to prevent the form from being displaced outwardly when the concrete is poured on the form's opposite or inward side.

The outward force of the concrete, and thus the concrete form, against the curb stakes has a tendency to cause the stakes to pivot outwardly, permitting the form to pivot along with them. If unchecked, this pivoting can result in the formation of a concrete pad having an undercut sidewall susceptible to chipping. Sometimes, this pivoting can even completely prevent the pouring of the pad.

In the past, this outward pivoting problem has frequently been prevented simply by using very long stakes, which can be driven a substantial distance into the ground. This is usually effective at preventing this outward pivoting. Since the stakes must be driven a substantial distance into the ground, however, additional labor costs are incurred in both driving the stakes into the ground and subsequently extracting them.

An alternative technique for preventing the outward pivoting of the concrete forms has been to use additional curb stakes, oriented at an angle with respect to the plane of the form, as shown in FIGS. 1 and 2. This solution is generally satisfactory, but requires the use of additional stakes, and, consequently, increased labor costs.

When finishing the surface of the concrete pad poured on the inward side of the concrete form, it is usually desirable to use a height adjustment and smoothing tool, such as a screed. Ideally, this tool is dragged along the top of the form, to smooth the concrete pad to a corresponding level. It is therefore important that the curb stakes be driven into the ground to a depth sufficient to bring their top surfaces to a level below that of the form. Driving the stakes to this depth can sometimes be difficult, especially when the stakes are relatively thin, as, for example, when they are formed from steel bar stock.

It should therefore be appreciated that there is a significant need for an improved curb stake that can resist both outward displacement and outward pivoting of a concrete form. Ideally, the curb stake should be configured so that it can be easily driven into the ground and subsequently extracted from it, and such that it can be readily driven into the ground to a level below the top surface of the form. The present invention fulfills this need.

SUMMARY OF THE INVENTION

This invention is embodied in a curb stake adapted to be driven into the ground adjacent to a concrete form, to secure the form in a prescribed position. The stake includes an elongated shaft having a lower end and an upper end, the lower end having a pointed tip to facilitate its being driven into the ground. In accordance with the invention, the stake further includes support means integral with the shaft and disposed on the side of the shaft opposite the concrete form, for engaging the ground when the shaft has been driven into it a predetermined distance. The support means prevents the shaft from pivoting away from the concrete form, whereby the curb stake resists both outward displacement and outward pivoting of the form when concrete is poured on its opposite side. Concrete pads with vertical sidewals can thereby be reliably formed.

More particularly, the support means includes a first horizontal member defining a lower support surface that is oriented substantially perpendicular to the axis of the shaft and that abuts the ground when the shaft has been driven the predetermined distance into the ground. A second horizontal member is secured to the shaft at or near its upper end, this member defining an upper impact surface that is oriented substantially perpendicular to the axis of the shaft. This surface is configured to be struck by a blunt instrument, such as a hammer, to drive the lower end of the shaft into the ground.

The support means further includes a second shaft secured to the remote ends of the first and second horizontal members. This shaft includes a spike projecting below the first horizontal member in substantially the same direction as the lower end of the first shaft. The spike includes a pointed tip to facilitate its being driven into the ground along with the lower end of the first shaft. The support surface and the spike cooperate to prevent outward pivoting of the curb stake and thus the concrete form.

The two horizontal members and the second generally vertical shaft cooperate to form an opening between them that is sized to permit insertion of an elongated tool. This tool can be used to extract the stake from the ground after the concrete pad has been finished and set.

In the preferred embodiment, both the shaft and the support means are formed of steel and are welded together to form a single integral unit. In addition, the entire support means is formed from a single, integral sheet.

Other features and advantages of the present invention should become apparent from the following description of the preferred embodiment, taken in conjunction with the accompanying drawings, which illustrate, by way of example, the principles of the invention.

DESCRIPTION OF THE PREFERRED EMBODIMENT

Figure 1:
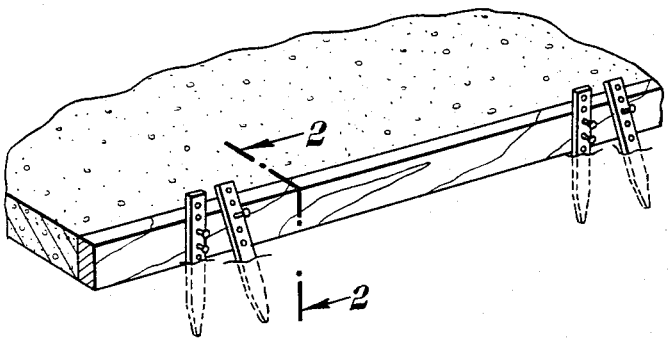
FIG. 1 PRIOR ART
FIG. 1 is a perspective view of a concrete form being held in position by a number of prior art curb stakes.
Figure 2:
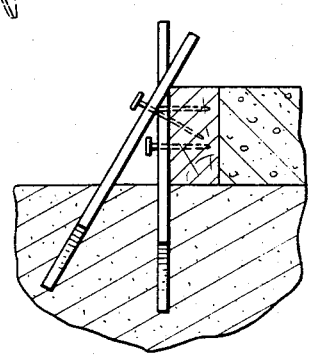
FIG. 2 PRIOR ART
FIG. 2 is a side view of the configuration of FIG. 1, taken in the direction of the arrows 2—2 in FIG. 1 and showing how two prior art curb stakes are required to adequately resist outward pivoting of the concrete form.
Figure 3:
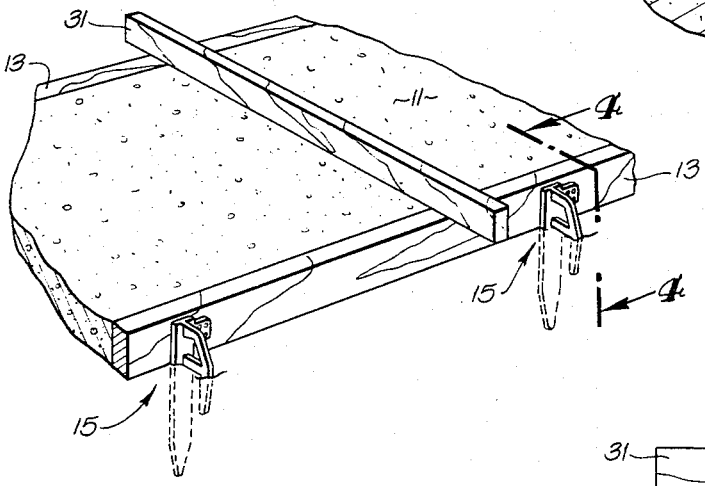
FIG. 3 is a perspective view of a concrete form being held in position by a number of curb stakes embodying the present invention.

Referring now to the drawings, and particularly to FIG. 3, there is shown a concrete form configuration for use in producing a concrete pad 11. The configuration includes a concrete form 13 located on each side of the pad, each form typically being formed of lengths of 2×4 or 2×6 lumber, laid end-to-end. The forms are held in place by a plurality of curb stakes 15, which are driven into the ground 17 immediately adjacent to the form's outwardly-facing side.

Figure 4:
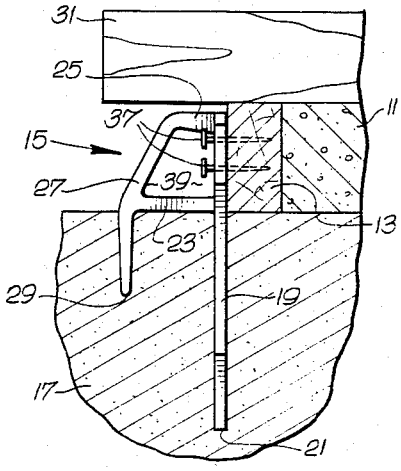
FIG. 4 is a side view of the curb stake of the present invention, depicting its elongated shaft and integral support means.
Figure 5:
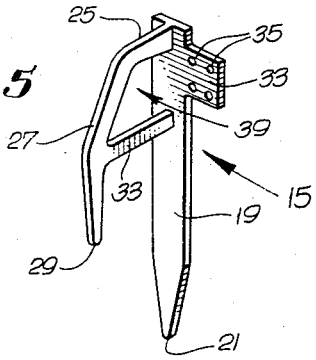
FIG. 5 is a perspective view of the curb stake of FIGS. 3 and 4.

As shown more specifically in FIGS. 4 and 5, each curb stake 15 includes an elongated shaft 19 that is, in use, oriented with its axis generally vertical. Its lower end includes a pointed tip 21 to facilitate its being driven into the ground 17 adjacent to the form 13. By itself, this shaft affords only limited resistance to outward pivoting of the form caused by the pressure of concrete 11 being poured on the inward side of the form.

In accordance with the invention, the curb stake 15 further includes a support structure integral with the shaft 19 and disposed on the side of the shaft opposite the concrete form 13, to engage the ground 17 and prevent the curb stake from pivoting outwardly in response to the pressure applied by the concrete 11. The concrete form is thereby held securely in place, to ensure that the concrete pad is formed with substantially vertical sidewalls.

More particularly, the integral support structure includes a lower horizontal member 23, an upper horizontal member 25 and a generally vertical member 27. These three members are preferably formed by flame-cutting a single $\frac{3}{8}$ inch steel sheet. The members are configured to have a shape generally corresponding to that of the letter "F". The free ends of the two horizontal members are welded to the shaft 19, with the upper member being welded at a location very near the shaft's upper end.

The lower horizontal member 23 has a flat bottom surface adapted to abut the ground 17 when the shaft 19 has been fully driven into the ground. This engagement with the ground functions to resist outward pivoting of the stake 15, since such pivoting could ordinarily occur only if the member digs into the ground.

The vertical member 27 includes a spike portion projecting below the lower horizontal member 23, generally parallel to the lower end of the shaft 19. The spike portion includes a pointed tip 29 that is driven into the ground 17 along with the shaft. This spike portion cooperates with the lower horizontal member to further resist outward pivoting of the concrete form 13.

The upper horizontal member 25 has a flat upper surface that can be conveniently used to drive the curb stake 15 into the ground 17 using, for example, a hammer. This surface is particularly advantageous because it projects a sufficient distance away from the form 13 to permit it to be struck by a hammer even when it is located even with or below the form's top edge. Permitting the stake to be pounded into the ground to this depth facilitates the subsequent finishing of the concrete pad 11 using a leveling device or screed 31 dragged along the top surface of the concrete form.

Projecting laterally from one side of the shaft 19 is a lug 33 having a number of holes 35 formed through it for use in nailing or otherwise securing the concrete form 13 to the 37 stake. The lug is sized to permit convenient driving of nails without interference from the support structure.

After the concrete pad 11 has been poured, finished and set, the curb stakes 15 and form 13 are removed from the ground 17. An opening 39 defined by the lower and upper members 23 and 25 and the vertical member 27 of the support structure facilitates an easy extraction of each stake. In particular, any suitable tool, such as the claw of a hammer, not shown, can be inserted into the opening and pulled upwardly against the upper horizontal member.

It should be appreciated from the foregoing description that the present invention provides an improved curb stake for use in securing a concrete form in a prescribed position. The improved stake includes an elongated shaft and an integral support structure to resist both outward displacement and outward pivoting of the concrete form when concrete is poured on its opposite or inward side. The support structure further provides a convenient means for driving the stake into the ground to a depth below that of the top edge of the concrete form, and, in addition, a convenient means of extracting the stake from the ground after the concrete pad has been formed.

Although the invention has been described in detail with reference to the presently-preferred embodiment, it will be understood by those of ordinary skill in the art that various modifications can be made without departing from the invention. Accordingly, the invention is limited only by the following claims.

We claim:

1. A curb stake adapted to be driven into the ground adjacent to a concrete form, to secure the form in a prescribed position, comprising:

an elongated shaft having a lower end and an upper end, the lower end having a pointed tip to facilitate its being driven into the ground immediately adjacent to a concrete form; and support means integral with the shaft and disposed on the side of the shaft opposite the concrete form, for engaging the ground when the shaft has been driven into the ground a predetermined distance, the support means preventing the shaft from pivoting in a direction away from the concrete form, whereby the curb stake resists both outward displacement and outward pivoting of the concrete form when concrete is poured on the side of the form opposite the curb stake, wherein the support means includes first means defining a support surface secured to the elongated shaft, the support surface being oriented substantially perpendicular to the axis of the shaft and abutting the ground when the shaft is driven the predetermined distance into the ground, second means defining an impact surface secured to the elongated shaft at or near its upper end, the impact surface being oriented substantially perpendicular to the axis of the shaft and configured to be struck by a blunt instrument, to drive the lower end of the shaft into the ground, and a second elongated shaft secured to the ends of the first and second means opposite the first elongated shaft, the second elongated shaft including a spike projecting below the first means and in substantially the same direction as the lower end of the first elongated shaft, the spike including a pointed tip to facilitate its being driven into the ground along with the lower end of the first elongated shaft, wherein the first means, second means, and second elongated shaft cooperate to form an opening therebetween sized to permit insertion of an elongated tool, for use in extracting the stake from the ground.

2. A curb stake as defined in claim 1, and further including a lug projecting laterally from the elongated shaft, at or near its upper end, the lug including at least one hole through it for use in securing the concrete form to the curb stake.

3. A curb stake as defined in claim 1, wherein the elongated shaft and the support means are both formed of steel and are welded together to form a single integral unit.

4. Concrete form apparatus for use in forming a concrete pad having a substantially vertical sidewall, comprising:

an elongated form disposed generally on or near the ground, the form having an inward side and an outward side and adapted to receive concrete adjacent to its inward side;

a plurality of curb stakes disposed adjacent to the outward side of the elongated form, each curb stake including an elongated shaft having a lower end and an upper end, the lower end having a pointed tip to facilitate its being driven into the ground immediately adjacent to the form, and support means integral with the shaft and disposed on the side of the shaft opposite the form, for engaging the ground when the shaft has been driven into the ground a predetermined distance; and attachment means for securing the elongated form to each of the curb stakes;

wherein the support means of each curb stake prevents the shaft from pivoting in a direction away from the form, whereby the curb stake resists both outward displacement and outward pivoting of the form when concrete is poured on its inward side;

and wherein the support means of each curb stake includes first means defining a support surface secured to the stake's elongated shaft, the support surface being oriented substantially perpendicular to the axis of the shaft and abutting the ground when the shaft is driven the predetermined distance into the ground, second means defining an impact surface secured to the stake's elongated shaft at or near its upper end, the impact surface being oriented substantially perpendicular to the axis of the shaft and configured to be struck by a blunt instrument, to drive the lower end of the shaft into the ground, and a second elongated shaft secured to the ends of the first and second means opposite the stake's first elongated shaft, the second elongated shaft including a spike projecting below the first means and in substantially the same direction as the lower end of the first elongated shaft, the spike including a pointed tip to facilitate its being driven into the ground along with the lower end of the first elongated shaft, wherein the first means, second means, and second elongated shaft cooperate to form an opening therebetween sized to permit insertion of an elongated tool, for use in extracting the stake from the ground.

5. Concrete form apparatus as defined in claim 4, wherein each of the curb stakes further includes a lug projecting laterally from the stake's elongated shaft, at or near its upper end, the lug including at least one hole through it for use in cooperation with the attachment means in securing the concrete form to the stake.

6. Concrete form apparatus as defined in claim 4, wherein the elongated shaft and support means of each curb stake are both formed of steel and are welded together to form a single integral unit.

7. Concrete form appartus as defined in claim 4, wherein the attachment means includes a plurality of nails.

8. A curbs take adapted to be driven into the ground adjacent to a concrete form, to secure the form in a prescribed position, comprising:

an elongated shaft having a lower end and an upper end, the lower end having a pointed tip to facilitate its being driven into the ground immediately adjacent to a concrete form;

first means defining a support surface secured to a mid-portion of the elongated shaft, the support surface being oriented substantially perpendicular to the axis of the shaft and abutting the ground when the shaft is driven the predetermined distance into the ground;

second means defining an impact surface secured to the elongated shaft at or near its upper end, the impact surface being oriented substantially perpendicular to the axis of the shaft and configured to be struck by a blunt instrument, to drive the lower end of the shaft into the ground;

a second elongated shaft secured to the ends of the first and second means opposite the first elongated shaft, the second elongated shaft including a spike projecting below the first means and in substantially the same direction as the lower end of the first elongated shaft, the spike including a pointed tip to facilitate its being driven into the ground along with the lower end of the first elongated shaft;

wherein the first means, second means, and second elongated shaft cooperate to form an opening therebetween sized to permit insertion of an elongated tool, for use in extracting the stake from the ground; and a lug projecting laterally from the elongated shaft, at or near its upper end, the lug including at least one hole through it for use in securing the concrete form to the curb stake.

* * * * *